US008354795B1

(12) United States Patent
Xiong

(10) Patent No.: US 8,354,795 B1
(45) Date of Patent: Jan. 15, 2013

(54) PROGRAM START BALLAST WITH TRUE PARALLEL LAMP OPERATION

(75) Inventor: Wei Xiong, Madison, AL (US)

(73) Assignee: Universal Lighting Technologies, Inc., Madison, AL (US)

( * ) Notice: Subject to any disclaimer, the term of this patent is extended or adjusted under 35 U.S.C. 154(b) by 313 days.

(21) Appl. No.: 12/785,944

(22) Filed: May 24, 2010

(51) Int. Cl.
*H05B 37/00* (2006.01)

(52) U.S. Cl. ..... 315/177; 315/219; 315/297

(58) Field of Classification Search ..... 315/94, 315/103, 105–107, 177, 219, 224–226, 291, 315/297, 307
See application file for complete search history.

(56) References Cited

U.S. PATENT DOCUMENTS 5,144,195 A * 9/1992 Konopka et al. ..... 315/94
5,877,592 A * 3/1999 Hesterman et al. ..... 315/106
5,920,155 A 7/1999 Kanda et al.
5,959,408 A * 9/1999 Steel et al. ..... 315/106
6,437,520 B1 8/2002 Grouev et al.
6,501,225 B1 * 12/2002 Konopka ..... 315/105
7,193,368 B2 3/2007 Chen et al.
7,247,991 B2 7/2007 Chen et al.
2003/0076055 A1 * 4/2003 Hooijer et al. ..... 315/224
2007/0262734 A1 11/2007 Venkat et al.
2009/0256481 A1 10/2009 Kalugumalai et al.

* cited by examiner

*Primary Examiner* — Tung X Le
(74) *Attorney, Agent, or Firm* — Waddey & Patterson, P.C.; Mark J. Patterson; Gary L. Montle

(57) ABSTRACT

A program start ballast powers multiple lamps coupled in parallel. A first inverter and a primary winding of a first transformer form a main circuit. A second inverter and a primary winding of a second transformer form a preheat circuit. One or more lamps are coupled in parallel across a secondary winding of the first transformer, and secondary windings of the second transformer are coupled across filaments at either end of the one or more lamps. The main circuit is configured to disable power across the first transformer during a preheat mode of operation and to provide power across the first transformer during a steady-state mode of operation. The preheat circuit is configured to provide power across the second transformer during the preheat mode of operation and to disable power across the second transformer during the steady-state mode of operation.

20 Claims, 4 Drawing Sheets

PROGRAM START BALLAST WITH TRUE PARALLEL LAMP OPERATION

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

This application claims benefit of the following patent application(s) which is/are hereby incorporated by reference: None

BACKGROUND OF THE INVENTION

The present invention relates generally to electronic ballasts configured for parallel discharge lamp operation. More particularly, the present invention relates to a program start ballast having a current-fed, parallel resonant inverter topology.

Referring to FIG. 1, an example is shown of a conventional electronic ballast topology with a current-fed, parallel resonant main circuit 100 for powering a load circuit 101 having multiple lamps coupled in parallel.

The input voltage V_bus may typically be provided from a power factor correction (PFC) section output. Coupled in series between the input voltage V_bus and ground are a pair of relatively large electrolytic capacitors C1, C2 having a substantially equal value. An inverter circuit formed of serially connected switching elements Q1, Q2 is coupled in parallel with the electrolytic capacitors C1, C2, with switching element Q1 coupled in parallel with capacitor C1 and switching element Q2 coupled in parallel with capacitor C2. Freewheeling diodes D1, D2 are coupled across the switching elements Q1, Q2, respectively.

The primary winding of a choke inductor L_choke_p is coupled between the collector of switching element Q1 and the input voltage V_bus, and the secondary winding of the choke inductor L_choke_s is coupled between the emitter of switching element Q2 and ground. A third capacitor C3 is further coupled in parallel with the inverter and opposite serially connected capacitors C1, C2.

A main resonant tank is coupled between the inverter output and a node between the capacitors C1, C2. The resonant tank is formed of a capacitor C_res in parallel with the primary winding T_res_p of a resonant transformer T_res. Lamps La1, La2 are further coupled across the secondary winding T_res_s of the resonant transformer T_res through capacitors C5, C6, respectively. A parallel resonant tank circuit may therefore be generally described with respect to each lamp coupled to the inverter circuit as including the resonant transformer T_res having a magnetizing inductance in shunt with resonant capacitor C_res and load-coupled capacitors C5, C6 . . . Cn. Prior to ignition of the lamps La1, La2, the input voltage V_bus charges a capacitor C4 through resistor network R3, R4. When the voltage on capacitor C4 reaches a threshold voltage the switching element Q2 may be turned on. In the example shown, the threshold voltage is embodied in the breakdown voltage of a diac 102, wherein the diac breaks down and substantially forms a short circuit such that the charge from capacitor C4 turns on switching element Q2. After the switching element Q2 turns on, the inverter starts to resonate and the secondary winding T_res_s of resonant transformer T_res, along with transformer windings T_res_base_1 and T_res_base_2 providing additional positive feedback via circuit components R2, D3, R1, D4, and driving switching elements Q1, Q2 in a self-oscillating fashion as the inverter reaches steady state.

The current-fed, parallel resonant inverter topology typically is used for instant start electronic ballasts. A particular advantage of this topology is that multiple lamps may be driven in parallel, which means that if one lamp fails other lamps may nevertheless continue to operate. However, instant start ballasts typically have substantially shorter lamp lives than program start ballasts, also referred to as programmed-start, soft-start, rapid-start or preheat ballasts. It would therefore be desirable to combine the advantageous features of the current fed parallel resonant inverter topology and program start ballasts to provide filament preheating for a number of lamps coupled in parallel.

As filament heating may result in a substantial amount of wasted power during steady-state operation of the lamps, it would be even further desirable to remove the filament heating source after the filaments have been properly heated, and during steady-state operation of the lamp.

As a voltage being provided across the lamps during filament preheat operation in many cases is known in the art to produce a small lamp current known as glow current, which causes filament erosion and substantially reduces lamp life, it would be even further desirable to provide little or no voltage across the lamps during the filament preheat period.

BRIEF SUMMARY OF THE INVENTION

Various embodiments of a program start ballast and methods of operating the same are herein provided having a current-fed parallel resonant inverter topology in accordance with the present invention.

The program start electronic ballast of the present invention in various aspects provides for longer lamp life while powering one or more lamps coupled in parallel such that any one lamp may fail without compromising the operability of the remaining lamps.

Program start electronic ballasts of the present invention in another aspect further provide a topology which allows for substantially zero voltage to be generated across the one or more lamps during a filament preheating stage.

The program start electronic ballast of the present invention in another aspect further provides a topology which allows for a filament preheating voltage which is not sensitive to the filament preheating frequency, and is further not sensitive to the number of lamp filaments which are connected to the ballast circuitry.

The program start electronic ballast of the present invention in another aspect further provides a topology which allows for the filament preheating voltage to be disabled or otherwise removed during steady state operation of the ballast.

Briefly stated, in one embodiment a program start ballast is provided for powering multiple lamps coupled in parallel. A first inverter and a primary winding of a first transformer form a main circuit. A second inverter and a primary winding of a second transformer form a preheat circuit. One or more lamps are coupled in parallel across a secondary winding of the first transformer, and secondary windings of the second transformer are coupled across filaments at either end of the one or more lamps. The main circuit is configured to disable power across the first transformer during a preheat mode of operation and to provide power across the first transformer during a steady-state mode of operation. The preheat circuit is configured to provide power across the second transformer during the preheat mode of operation and to disable power across the second transformer during the steady-state mode of operation.

In another embodiment, a program start ballast of the present invention includes a DC power source and a parallel resonant inverter block coupled to receive DC power from the DC power source. The parallel resonant inverter block is configured to generate AC power across a load block which includes one or more lamps coupled in parallel. The AC power is generated after a predetermined period of time measured from initially receiving DC power from the DC power source. A filament preheat block is also coupled to receive DC power from the DC power source, and includes a pair of switches forming a half bridge switching circuit, a driver circuit configured to provide driver signals to the switching circuit, and a control circuit. The control circuit enables the driver circuit to provide driver signals during a first mode of operation and disables the driver circuit during a second mode of operation. The filament preheat block is configured to generate AC power from the switching circuit across lamp filaments at either end of each of the one or more lamps in the load block during the first mode of operation.

In another embodiment of the present invention, a method is provided for heating filaments for one or more lamps coupled in parallel by a ballast which includes a main circuit having a first inverter and a first transformer coupled to an output terminal of the first inverter, a filament heating circuit having a second inverter and a second transformer coupled to an output terminal of the second inverter, and a load circuit effective to receive the one or more lamps. A first step of the method includes providing DC power to the main circuit and the filament heating inverter circuit. A second step of the method includes enabling the second inverter during a first mode of operation to generate a first predetermined voltage across filaments at either end of each of the one or more lamps. A third step of the method includes disabling the second inverter after the first mode of operation and during a second mode of operation. A fourth step of the method includes enabling the first inverter after the first mode of operation and during the second mode of operation to generate a second predetermined voltage across each of the one or more lamps.

DETAILED DESCRIPTION OF THE INVENTION

Throughout the specification and claims, the following terms take at least the meanings explicitly associated herein, unless the context dictates otherwise. The meanings identified below do not necessarily limit the terms, but merely provide illustrative examples for the terms. The meaning of "a," "an," and "the" may include plural references, and the meaning of "in" may include "in" and "on." The phrase "in one embodiment," as used herein does not necessarily refer to the same embodiment, although it may.

The term "coupled" means at least either a direct electrical connection between the connected items or an indirect connection through one or more passive or active intermediary devices.

The term "circuit" means at least either a single component or a multiplicity of components, either active and/or passive, that are coupled together to provide a desired function.

The term "signal" means at least one current, voltage, charge, temperature, data or other signal.

The terms "switching element" and "switch" may be used interchangeably and may refer herein to at least: a variety of transistors as known in the art (including but not limited to FET, BJT, IGBT, IGFET, etc.), a switching diode, a silicon controlled rectifier (SCR), a diode for alternating current (DIAC), a triode for alternating current (TRIAC), a mechanical single pole/double pole switch (SPDT), or electrical, solid state or reed relays. Where either a field effect transistor (FET) or a bipolar junction transistor (BJT) may be employed as an embodiment of a transistor, the scope of the terms "gate," "drain," and "source" includes "base," "collector," and "emitter," respectively, and vice-versa.

Figure 1:
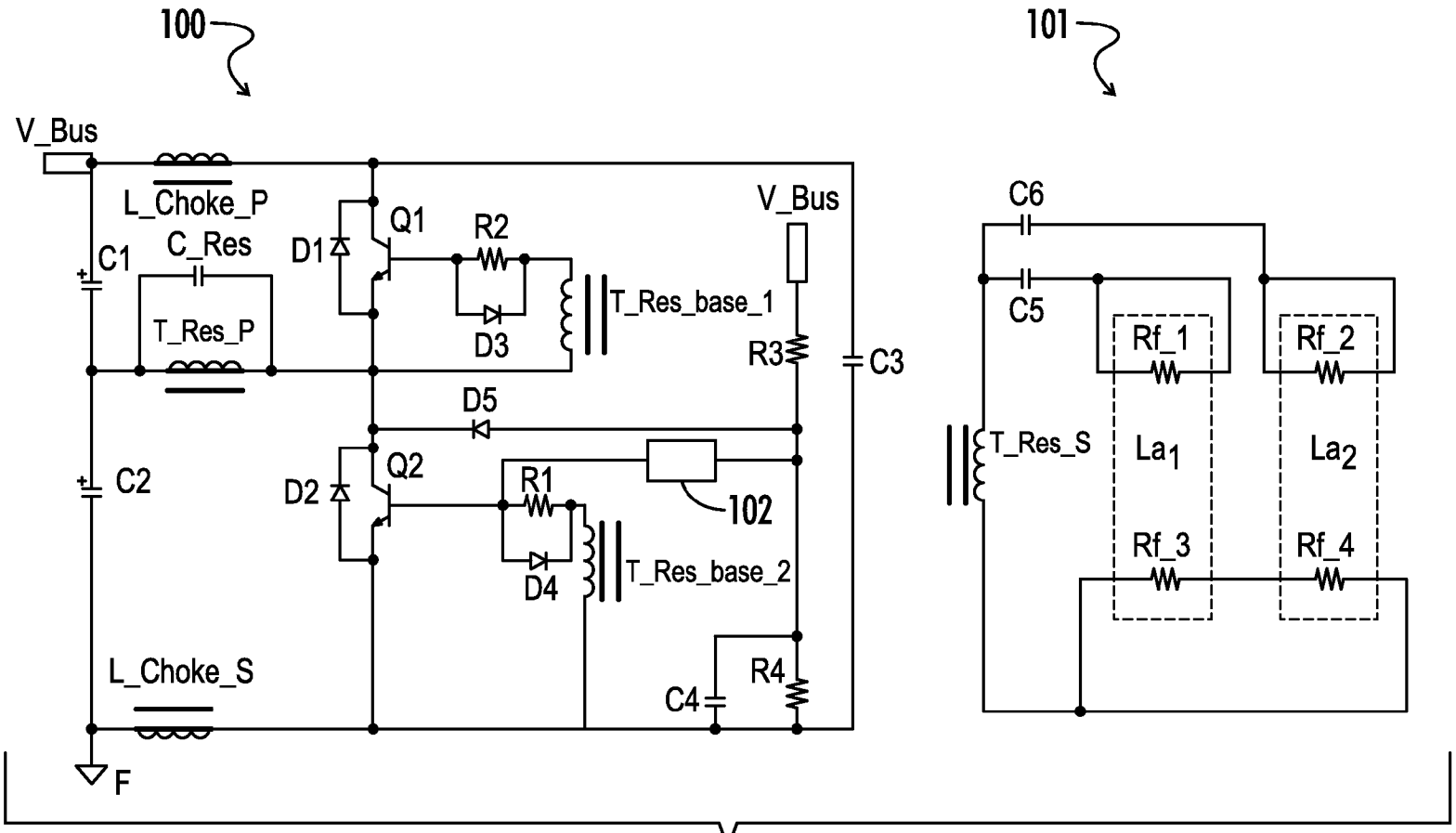
FIG. 1 (PRIOR ART)
FIG. 1 is a circuit schematic showing an example of an electronic ballast topology as previously known in the art.
Figure 2:
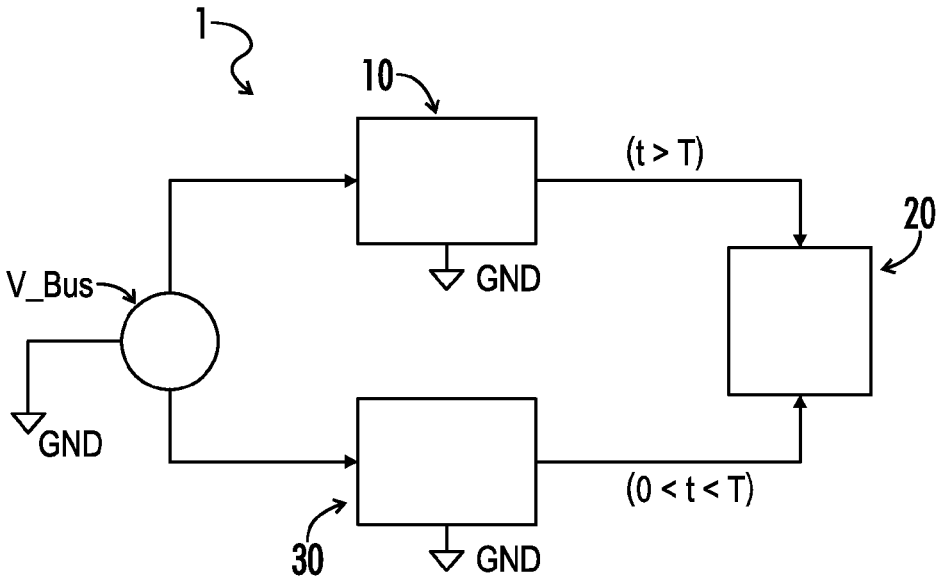
FIG. 2 is a block diagram of an embodiment of an electronic ballast of the present invention.
Figure 3A:
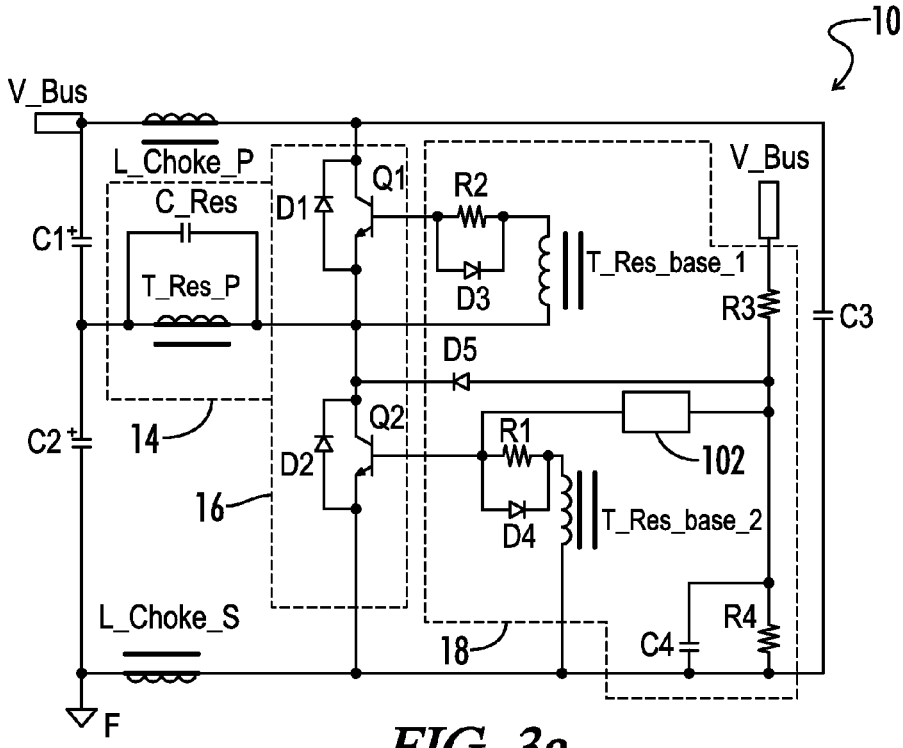
FIGS. 3*a*-3*c* are circuit schematics of various circuit blocks from an embodiment of the ballast of FIG. 2.
Figure 3B:
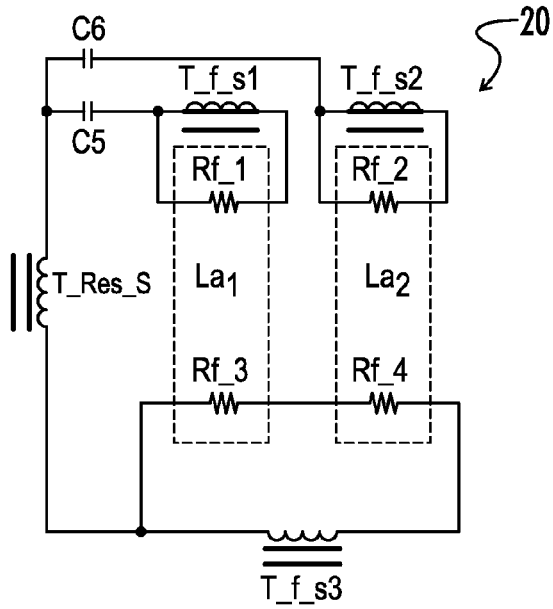
Figure 3C:
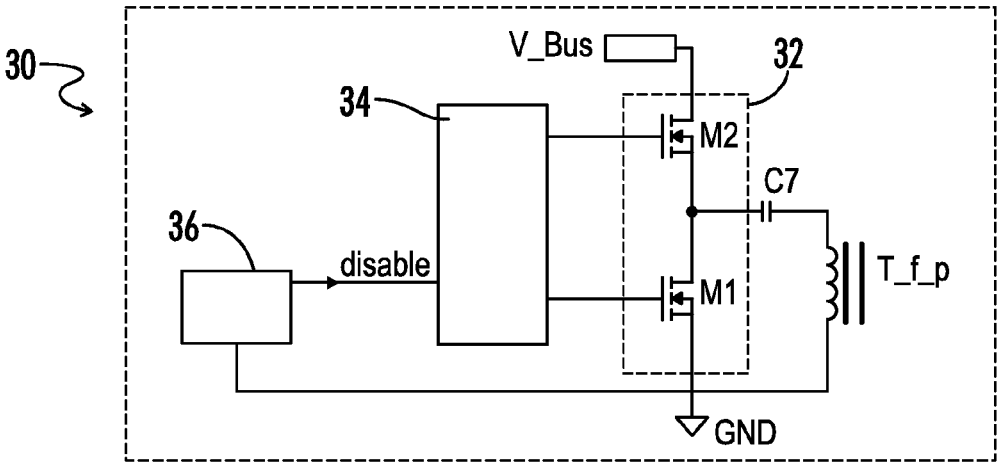
Figure 4:
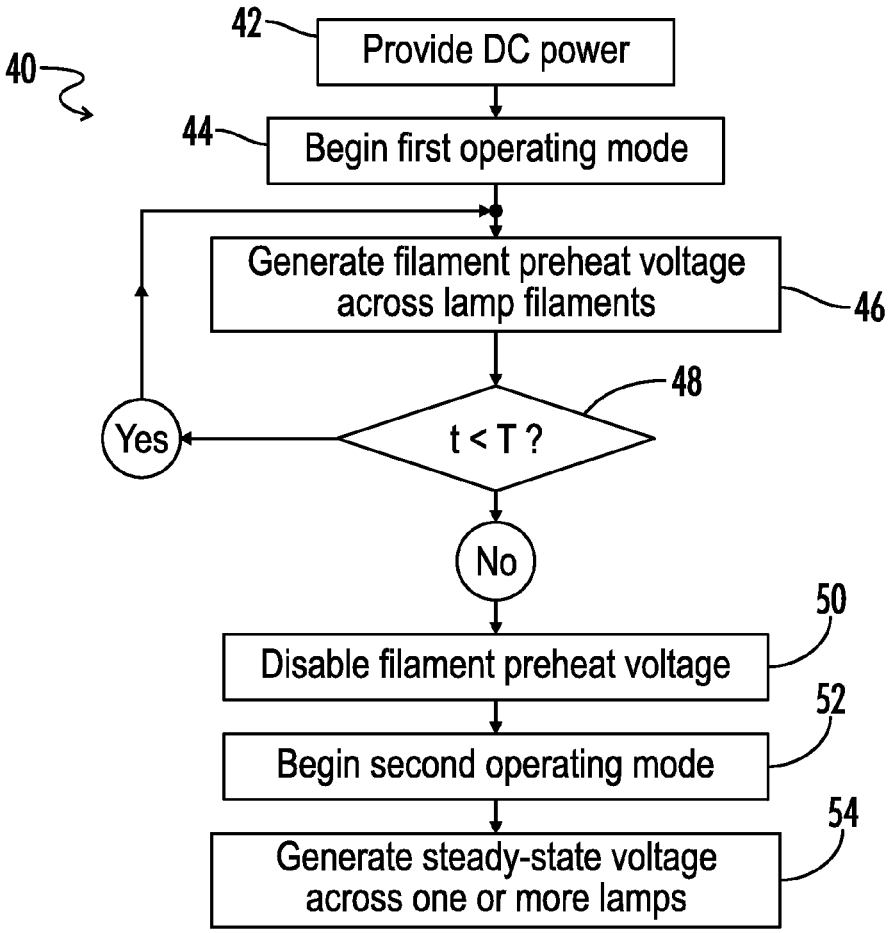
FIG. 4 is a flowchart of an embodiment of a method of operation of the ballast of FIG. 2.

Referring generally to FIGS. 2-4, various embodiments of a program start ballast and methods of operating the same may be described herein. Where the various figures may describe embodiments sharing various common elements and features with other embodiments of the present invention or with the conventional example shown in FIG. 1 and described above in the Background section, similar elements and features are given the same reference numerals and redundant description thereof may be omitted below.

Referring first to FIG. 2, in various embodiments a lamp ballast 1 in accordance with the present invention includes a main circuit block 10 (or main circuit) and a filament preheat circuit block 30 (or preheat circuit), each electrically coupled to receive DC power from a DC source V_bus. The DC source V_bus may typically be an output from a PFC controller as described above, but various alternative sources are anticipated within the scope of the invention. The main circuit block 10 and the filament preheat circuit block 30 are each magnetically coupled to a load circuit block 20 (or load) which includes one or more lamps La1 . . . Lan, and are configured to provide an output voltage to the one or more lamps. The topology of ballast 1 allows for the one or more lamps La to be coupled in parallel, such that failure of any one lamp La does not compromise operation of the remaining and functional lamps La.

In an embodiment as shown in FIG. 2, the load circuit block 20 receives an output voltage from the main circuit 10 and the filament preheat circuit block 30 in accordance with a first and a second operating mode for the ballast. In a first operating mode, or preheat mode, where the amount of time (t) measured from DC power being initially supplied from the DC source V_bus is less than a predetermined period of time (T), an AC voltage is provided from the filament preheat circuit block 30 to the load circuit block 20. In a second operating mode, or steady-state mode, where the amount of time (t) measured from DC power being initially supplied from the DC source V_bus exceeds the predetermined period of time (T), an AC voltage is provided from the main circuit block 10 to the load circuit block 20.

In various embodiments of the present invention, the first and second operating modes may overlap somewhat without adversely affecting operation of the ballast 1, and in fact such overlap may be predetermined with the purpose of assuring that a voltage is applied to preheat lamp filaments at all times prior to ignition of the lamps.

With reference to FIGS. 3*a*-3*c*, additional description of the various circuit blocks 10, 20, 30 of the ballast 1 may be provided herein.

The main circuit 10 in various embodiments includes substantially similar circuitry and functionality as with the conventional main circuit 100 described above, and detailed description will thereby be omitted as redundant.

The filament preheat circuit block 30 in an embodiment includes a pair of switching elements M1, M2 arranged in a half bridge configuration. As shown in FIG. 3*c*, the switching elements M1, M2 make up a switching circuit 32 coupled on a first end to receive DC power from the DC source V_bus and on a second end to ground GND. The switching circuit 32 is configured to convert the DC power into AC power at an output terminal of the switching circuit 32, which may further be referred to as a second inverter circuit 32 with respect to the first inverter circuit 16 of the main circuit block 10.

Each of the switching elements M1, M2 may in various embodiments be a metal-oxide-semiconductor field-effect transistor (MOSFET) driven in turn by a self-oscillating half bridge driver circuit 34 at a predetermined frequency. The driver circuit 34 provides drive signals, which may be pulse width modulated signals, to the gate electrodes of the switching elements M1, M2 to alternately permit current flow between source and drain electrodes of the switching elements M1, M2 and thereby generate a second inverter output voltage. A DC blocking capacitor C7 is coupled on a first end to the output terminal of the second inverter 32 and on a second end to the primary winding of a filament drive transformer T_f_p. A filament heating voltage is thus generated by the second inverter 32 and provided across the filament drive transformer T_f_p when the driver circuit 34 is enabled. The filament heating voltage so generated is not sensitive to the preheat frequency, and is further not sensitive to the number of lamps in the load circuit, nor likewise to the number of filaments which require heating.

A control circuit 36 is coupled to the driver circuit 34 and configured to enable or disable operation of the driver circuit 34 and thereby operation of the switches M1, M2. Referring to the main circuit 10 as described above, values for the various components in the RC network R3, R4, C4 may be selected such that the amount of time for a charge on the capacitor C4 to achieve the breakdown voltage of breakdown circuit 102 is designed to equal a predetermined amount of time T needed to adequately preheat filaments of the one or more lamps La. The control circuit 36 may be further programmed or otherwise configured to operate in accordance with this predetermined period of time T.

When DC power is initially supplied by the DC source V_bus to the filament preheat circuit 30, the control circuit 36 begins a first mode of operation, or filament preheat mode, and enables the driver circuit 34 to begin driving the switching elements M1, M2 at the predetermined preheat frequency. The control circuit 36 then begins internally clocking the time. While the time elapsed t from the beginning of the filament preheat mode is less than the predetermined amount of time T ($0<t<T$), the control circuit 36 maintains the driver circuit 34 in an enabled state. When the time elapsed t since the beginning of the filament preheat mode meets or exceeds the predetermined amount of time T ($T \leqq t$), the control circuit 36 disables the driver circuit 34.

Referring to FIG. 3*b*, the load circuit block 20 in various embodiments may include a plurality of secondary windings T_f_s1 . . . T_f_sn of the filament drive transformer T_f coupled to one or more sets of lamp terminals. Two lamps La1, La2 are shown connected to lamp terminals in FIG. 3*b*, but a larger number of lamps may be powered by the ballast 1 of the present invention without affecting the preheat voltage applied across each of the lamp filaments provided. The secondary windings T_f_s1, T_f_s2, T_f_s3 of the filament drive transformer T_f in such an embodiment as shown may be coupled via the lamp terminals across the individual filaments Rf_1 to Rf_4 at either end of the one or more lamps La1, La2 provided in the load circuit block 20. Each lamp La has a secondary winding T_f_s1, T_f_s2 of the filament drive transformer T_f coupled via lamp filament terminals across a filament Rf_1, Rf_2 on a first end of the lamp La1, La2. Further, the one or more lamps La1, La2 collectively have a single secondary winding T_f_s3 coupled via lamp filament terminals across each of the filaments Rf_3, Rf_4 on a second end of the lamps. The filament configurations however may vary in embodiments within the scope of the present invention.

In various embodiments the control circuit 36 in the filament preheat circuit block 30 may be a microcontroller. A reduced-cost alternative within the scope of the present invention may be to provide, for example, a capacitor with a charge time designed to meet or exceed the predetermined amount of time for the first mode of operation, after which an associated switching element is turned on and the driver circuit 34 disabled. In such an example, the driver circuit 34 may further be formed of an integrated circuit 34 having a disable terminal coupled to the output of the switching element of the control circuit 36.

As previously described, the capacitor C4 is designed to store a charge that reaches the breakdown voltage of breakdown circuit 102 in the predetermined amount of time T, or in other words generally at the conclusion of the first operating mode. The breakdown circuit 102 in various embodiments may be a diac 102 which at that time breaks down and represents a short circuit, thereby allowing the capacitor C4 to turn on the switching element Q2 and begin the second mode of operation by enabling the first inverter 16.

With reference now to FIGS. 3-4 generally, an embodiment of a method of operation 40 for the ballast 1 of the present invention may now be described.

In step 42, the method 40 begins by providing DC power to the main circuit 10 and the filament preheat circuit 30. In the main circuit 10, DC power is coupled to a delay circuit 18 which is further formed of a storage circuit R3, R4, C4 and a breakdown circuit 102. The delay circuit 18 prevents a breakdown voltage for the breakdown circuit 102 from being achieved until after a delay of some time, and the components of the storage circuit R3, R4, C4 may preferably be designed with relative values such that the resultant delay is generally equal to a predetermined amount of time which is adequate to preheat filaments for one or more lamps which may be coupled to the ballast.

In step 44, the method 40 continues by beginning the first operating mode, or filament preheat mode, for the ballast 1. While the delay circuit 18 is charging up to the breakdown voltage of the breakdown circuit 102, and while the parallel resonant inverter circuit 16 of the main circuit block 10 is thereby disabled, a control circuit 36 in the filament preheat circuit block 30 enables a driver circuit 34. The driver circuit 34 in step 46 begins generating driver signals at a predetermined preheat frequency to the gates of switches M1, M2 arranged in a half bridge configuration as a second inverter 32. The switches M1, M2 thereby generate a filament preheat voltage at an output terminal to which the primary winding T_f_p of a filament drive transformer T_f is coupled, via a DC blocking capacitor C7. As previously described, the secondary windings T_f_s of the filament drive transformer T_f are coupled across the various filaments for the one or more lamps in the load circuit block 20, thereby applying the generated filament preheat voltage across the lamp filaments for the duration of the first operating mode.

In step 46, the control circuit 36 clocks the amount of time elapsed t as measured from the beginning of the first operating mode, or alternatively stated from the initiation of DC power from the DC source V_bus, and compares the elapsed time t to the predetermined amount of time T for the first operating mode as determined by or otherwise relevant in light of the charge time for the delay circuit 18 in the main circuit block 10.

Where the elapsed time t is less than the predetermined amount of time T ($0<t<T$), the method returns to step 46 and continues generating, or alternatively, maintains the filament preheat voltage across the lamp filaments.

Where the elapsed time t meets or exceeds the predetermined amount of time T ($t>T$), the control circuit 36 instead generates a signal to disable the driver circuit 34 (step 50). In various embodiments the control circuit 36 may be a microprocessor 36, in which case step 50 may involve generating a pulse signal to a disable pin on the driver circuit 34, which may be an integrated circuit 34 configured to disable the second inverter 32 in response to the disable signal. Alternatively the control circuit 36 may include discrete circuitry which, for example, turns on a switching element after determining the predetermined amount of time has been elapsed, such as by charging a capacitor having an appropriately designed charge time, and subsequently triggers the disable pin on the driver circuit 34.

In various embodiments the filament preheat voltage will now be disabled and remain disabled until DC power is turned off and subsequently supplied again from the DC source V_bus.

After the predetermined amount of time has elapsed, or otherwise stated after the delay circuit 18 has charged up to the breakdown voltage for the breakdown circuit 102, the method continues in step 52 by beginning the second operating mode. The main circuit block 10 includes circuitry which enables the first inverter circuit 16, or otherwise stated begins driving the first inverter circuit 16 in oscillating fashion as described above, and thereby generates a voltage across the primary winding T_res_p of the resonant transformer T_res in a resonant circuit 14 of the main circuit block 10. The secondary transformer T_res_s is coupled across the one or more lamps in the load circuit block 20, thereby generating voltage across the lamps.

In various embodiments the second operating mode may be described as including a lamp ignition operating mode and a steady-state operating mode, as various signal characteristics may vary accordingly. Further, in various embodiments the ballast 1 may include a dimming mode with even further varying characteristics. However, within the scope of the present invention the operating characteristics of the output voltage from the main circuit block 10 after conclusion of the preheat operating mode are less consequential than those of the filament preheat block 30, and for the purposes of this paper the operating modes post-filament preheating may be collectively referred to as a second mode, or a steady-state mode, wherein the first inverter 16 achieves a steady-state and a steady-state voltage is applied across the one or more lamps (step 54).

The previous detailed description has been provided for the purposes of illustration and description. Thus, although there have been described particular embodiments of the present invention of a new and useful "Program Start Ballast with True Parallel Lamp Operation," it is not intended that such references be construed as limitations upon the scope of this invention except as set forth in the following claims.

What is claimed is:

1. A program start ballast for one or more lamps coupled in parallel comprising:

a main circuit comprising a first inverter circuit and a primary winding of a first transformer;

a preheat circuit comprising a second inverter circuit and a primary winding of a second transformer; and a load circuit comprising a secondary winding of the first transformer and lamp terminals coupled in parallel across the secondary winding of the first transformer, the load circuit further comprising a plurality of secondary windings of the second transformer, each secondary winding of the second transformer coupled to respective lamp filament terminals, wherein the main circuit is functional to disable power across the primary and secondary windings of the first transformer during a preheat mode of operation and to provide power across the primary and secondary windings of the first transformer during a steady-state mode of operation, and wherein the preheat circuit is functional to provide power across the primary and secondary windings of the second transformer during the preheat mode of operation and to disable power across the primary and secondary windings of the second transformer during the steady-state mode of operation.

2. The ballast of claim 1, wherein the main circuit further comprises a first inverter circuit having first and second switches, and a first driver circuit functional to generate oscillation in the first and second switches after a predetermined period of time measured from DC power being supplied from a DC power source.

3. The ballast of claim 2, the first driver circuit further comprising a storage circuit coupled to the DC power source and a breakdown circuit coupled between the storage circuit and the first and second switches, the storage circuit functional to charge up to a breakdown value of the breakdown circuit after the predetermined period of time.

4. The ballast of claim 3, the storage circuit further comprising a capacitor and one or more resistors having relative values associated with the predetermined period of time.

5. The ballast of claim 4, the breakdown circuit comprising a diac.

6. The ballast of claim 2, wherein the preheat circuit further comprises a second inverter circuit having first and second switches and a second driver circuit functional to generate oscillation in the first and second switches for a predetermined period of time measured from DC power being supplied from the DC power source.

7. The ballast of claim 6, the steady-state mode of operation comprising the period of time during which the first inverter supplies power across the first transformer, the preheat mode of operation comprising the period of time during which the second inverter supplies power across the second transformer.

8. The ballast of claim 7, wherein power from the second inverter output is disabled during the steady state mode of operation.

9. The ballast of claim 8, the preheat circuit further comprising a microprocessor functional to enable the second driver circuit after DC power is initially supplied from the DC power source, internally clock the predetermined period of time, and disable the second driver circuit after the predetermined period of time.

10. A program start ballast for one or more lamps coupled in parallel comprising:

a DC power source;

a parallel resonant inverter block coupled to receive DC power from the DC power source and operable to generate AC power across lamp terminals in a load block configured to connect one or more lamps coupled in parallel, the AC power generated after a predetermined period of time measured from initially receiving DC power and;

a filament preheat block coupled to receive DC power from the DC power source and further comprising a pair of switches forming a half bridge switching circuit, a driver circuit operable to provide driver signals to the switching circuit, and a control circuit operable to enable the driver circuit to provide driver signals during a first mode of operation and to disable the driver circuit during a second mode of operation, wherein the filament preheat block is operable to generate AC power across lamp filaments at either end of each of the one or more lamps in the load block during the first mode of operation.

11. The ballast of claim 10, the filament preheat block further comprising a primary winding of a filament preheat transformer coupled between the pair of switches, and the load block further comprising a plurality of secondary windings of the filament preheat transformer, wherein secondary windings of the filament preheat transformer are coupled across one or more sets of lamp filament terminals.

12. The ballast of claim 11, wherein one or more secondary windings of the filament preheat transformer are individually coupled across each set of lamp filament terminals on a first end, and wherein a secondary winding of the filament preheat transformer is collectively coupled across each set of lamp filament terminal on a second end.

13. The ballast of claim 10, the control circuit further comprising a microcontroller.

14. The ballast of claim 13, the microcontroller functional to internally clock a predetermined period of time associated with the first mode of operation, during which the microcontroller is operable to enable operation of the driver circuit, and after which the microcontroller is operable to disable operation of the driver circuit.

15. The ballast of claim 10, the parallel resonant inverter block further comprising a breakdown circuit functional to delay generation of AC power by the parallel resonant inverter block during the first mode of operation.

16. The ballast of claim 15, the breakdown circuit further comprising a diac having a breakdown voltage, and an RC network coupled between the DC source and the diac and arranged to charge up to the breakdown voltage over the predetermined period of time.

17. A method of heating filaments for one or more lamps coupled in parallel in an electronic ballast configuration, the ballast further including a main circuit having a first inverter and a first transformer coupled to an output terminal of the first inverter, a filament heating circuit having a second inverter and a second transformer coupled to an output terminal of the second inverter, and a load circuit effective to receive the one or more lamps, the method comprising:

providing DC power to the main circuit and the filament heating inverter circuit;

enabling said second inverter during a first mode of operation to generate a first predetermined voltage across filaments at either end of each of the one or more lamps;

disabling said second inverter after said first mode of operation and during a second mode of operation and;

enabling said first inverter after said first mode of operation and during said second mode of operation to generate a second predetermined voltage across each of the one or more lamps.

18. The method of claim 17, wherein the step of enabling said second inverter during a first mode of operation further comprises providing control signals to a driver circuit, said driver circuit configured to drive a plurality of switches comprising said second inverter at a predetermined frequency.

19. The method of claim 18, wherein the step of disabling said second inverter further comprises clocking a predetermined period of time from initially receiving DC power from the DC source, and disabling control signals to the driver circuit after the predetermined period of time elapses, the predetermined period of time associated with the first mode of operation.

20. The method of claim 19, wherein the step of enabling said first inverter further comprises providing breakdown circuitry in said main circuit coupled between the DC source and the first inverter, and effective to disable the first inverter prior to reaching a breakdown voltage, and providing delay circuitry in said main circuit effective to delay the breakdown circuitry from reaching the breakdown voltage until after the predetermined period of time is elapsed.

* * * * *